US005086971A

United States Patent [19]

Detzel et al.

[11] Patent Number: 5,086,971

[45] Date of Patent: Feb. 11, 1992

[54] FOLDED CONTAINER

[75] Inventors: Josef Detzel; Walter Schraegle, both of Kempten; Rudolf Kraus, Osterreinen, all of Fed. Rep. of Germany

[73] Assignee: Lever Brothers Company, Division of Conopco, Inc., New York, N.Y.

[21] Appl. No.: 442,357

[22] PCT Filed: Mar. 16, 1989

[86] PCT No.: PCT/EP89/00278

§ 371 Date: Nov. 1, 1989

§ 102(e) Date: Nov. 1, 1989

[51] Int. Cl.[5] ..... B65D 5/24

[52] U.S. Cl. ..... 229/188; 229/186

[58] Field of Search ..... 229/188, 149, 186, 195; 206/607

[56] References Cited

U.S. PATENT DOCUMENTS

| | | | |
|---|---|---|---|
| 1,190,797 | 7/1916 | Powell | 229/188 |
| 1,672,251 | 6/1928 | Fox | 229/195 |
| 1,705,607 | 3/1929 | Engel | 229/195 |
| 2,789,750 | 4/1957 | Kramer | 229/188 |
| 3,008,626 | 11/1961 | Lawrence | 229/188 |
| 3,040,956 | 6/1962 | Skowronski | 229/188 |
| 3,067,924 | 12/1962 | Baker et al. | 229/188 |
| 3,973,723 | 8/1976 | Owens | 29/149 |
| 4,738,365 | 4/1988 | Prater | 206/607 |

FOREIGN PATENT DOCUMENTS

| | | | |
|---|---|---|---|
| 0549247 | 11/1957 | Canada | 229/149 |
| 042531 | 8/1933 | France | 229/195 |
| 1240882 | 8/1960 | France | 229/195 |

*Primary Examiner*—Stephen Marcus
*Assistant Examiner*—Christopher McDonald
*Attorney, Agent, or Firm*—Ronald A. Koatz

[57] ABSTRACT

Folded container with a base and four side panels that are connected by pairs of gusset sections which are folded into place. One section of each of the pairs of gusset sections is provided with a tap which rests against and is attached to the outside of one side panel once the side panels have been folded upwards. A particularly effective way to attach these tabs is to provide cut lines in the side panel which the tabs engage and lock with.

2 Claims, 1 Drawing Sheet

FOLDED CONTAINER

The invention relates to a folded container with a base and four side panels that are connected by pairs of gusset sections which are folded into place.

Such folded containers are in common practical use; they have the serious disadvantage that the gusset sections have to be glued directly to a side panel. This makes considerable machine equipment necessary, so that it is practically impossible to erect these known folded containers manually.

DE-OS 36 10 615 also discloses a folded container which is designed in such a way that the side panels brace themselves against each other, so that the container remains erected. It is very simple to erect this container, but there is no absolute security that the container will not fall apart unintentionally.

The purpose of the present invention is to propose a folded container of the kind outlined above, that is easy to erect but at the same time guarantees absolutely that the container will not fall apart unintentionally.

In the solution to this problem proposed by the invention one section of each of the pairs of gusset sections is provided with a tab which rests against and is attached to the outside of one side panel once the side panels have been folded upwards. The advantage of such a tab is that it is easily accessible, so that it is no problem to attach it to the side panel.

Attachment of the tab is simplified even more if in accordance with the invention cut lines, in which the tabs lock, are provided in the side panels in the area of the tabs.

It is also very advantageous if in accordance with the invention cut lines are provided in pairs located a distance apart, the middle sections of which meet while the middle section of the tabs is somewhat wider and locks behind the side panel sections defined by the two cut lines. The widest parts of the tab are the only parts to be in the interior of the carton when the tabs engage the cut lines. In this way the tabs are locked very securely simply by pressing them inwards.

The cut lines in the side panel essentially represent two C-shaped cuts that are back to back. If the cuts are designed in this way, the tabs can simply be placed against the side panel and pressed in, either manually or with a simple tool.

It is also very favourable if in accordance with a further embodiment of the invention the tabs are provided with a folding line that runs parallel to the theoretical line with which they are hinged to the gusset section. This folding line makes it considerably easier to press in and lock the tabs.

In a further very advantageous embodiment of the invention, one of the side panels is provided with two tear lines extending from the top to the bottom.

These tear lines make it possible to detach and fold down the central section of the side panel, which facilitates removal of the product considerably.

The drawing shows one embodiment of the invention:

Figure 1:
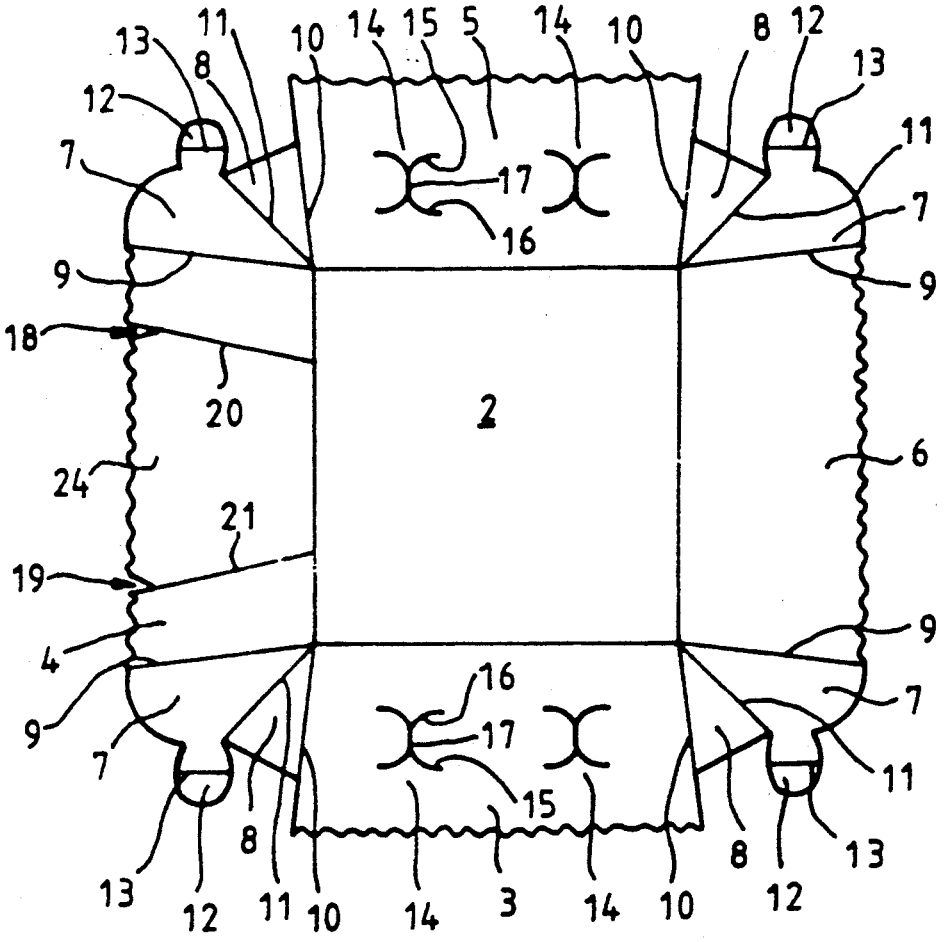
FIG. 1 shows a flat board blank.

1 in FIG. 1 is a board blank that has a base 2 to which four side panels 3, 4, 5 and 6 are hinged. Pairs of gusset sections 7, 8, which are connected to the side panels via folding lines 9, 10 and to each other via a folding line 11, are located between the side panels.

The length of the gusset section 7 hinged to the side panel 4/6 corresponds to the height of this side panel, while the gusset section 8 is shorter. A tab 12, which is provided on the gusset section 7 and has a folding line 13, projects into the space left as a result.

The roughly back-to-back C-shaped cut patterns 14, represented by the upper and lower curves of the "C" 15 and 16 and the middle section of the "C" 17, are provided in the two side panels 3 and 5.

The free edge of the side panel 4 has two notches 18, 19, from which two tear lines 20, 21 extend to the line hinging the side panel 4 to the base 2. A section 24 is thus divided off from the side panel and can be detached along the two tear lines.

Figure 2:
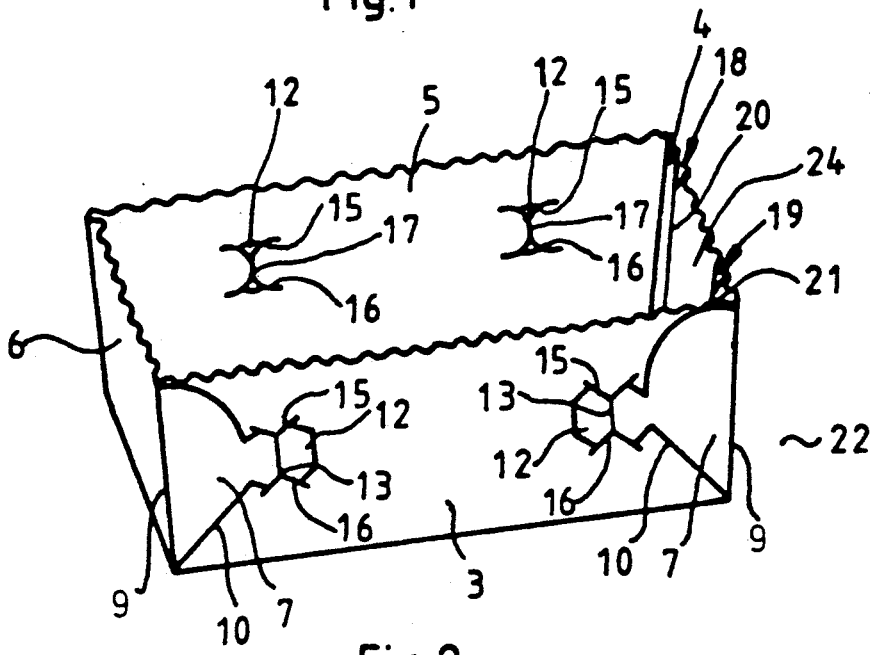
FIG. 2 shows a folded container erected from the blank illustrated in FIG. 1.

In FIG. 2 a folded container 22 has been erected from the board blank by folding the side panels 3, 4, 5 and 6 upwards. The two gusset sections have been folded on top of each other along the folding line 10, as a result of which only the outer section 7 is visible. The tab 12 provided on this section 7 has been pressed behind the side panel 3/5 in the area of the two cut lines 15 and 16, with only two very small sections of the tab 12 (i.e., the widest parts of the tab) projecting inside the folded container 22, as can be seen on side panel 5. The shape of the cut lines 15, 16 and the wider middle section of the tab 12 guarantee nevertheless that the tab is held in position securely enough.

We claim:

1. Folded container made from a single-piece board blank wherein said container comprises (1) a base;

(2) four side panels (3, 4, 5, 6) hinged to said base; and (3) a pair of gusset sections (7, 8) connecting each adjacent side panel; wherein one section of each pair of gusset sections is provided with a tab (12) and wherein two of the said panels (3, 5) comprise areas for engaging each tab;

each of said areas for engaging each tab being defined by two back-to-back C-shaped cuts, wherein the back-to-back C-shaped cuts are in turn defined by cut lines (15, 16) representing the upper and lower section of the C-shape and by a middle section 17 where the back-to-back C-shapes meet;

wherein a middle section of the tab (12) is somewhat wider than end sections of the tab and is the only part of the tab in the interior of the folded container.

2. Folded container according to claim 1, wherein the tab is provided with a folding line (13) that runs parallel to line (10) with which it is hinged to the gusset section (7).

* * * * *